United States Patent [19]

Halliday et al.

[11] Patent Number: 4,790,891

[45] Date of Patent: Dec. 13, 1988

[54] PROCESS FOR THE PRODUCTION OF A CARTRIDGED EXPLOSIVE WITH ENTRAPPED BUBBLES

[75] Inventors: Pieter S. J. Halliday, Randburg; Allan J. Harris, Knoppigslaagte, both of South Africa

[73] Assignee: AECI Limited, Johannesburg, South Africa

[21] Appl. No.: 70,724

[22] Filed: Jul. 7, 1987

[30] Foreign Application Priority Data

Nov. 4, 1986 [ZA] South Africa ..... 8410

[51] Int. Cl.[4] ..... C06B 45/00

[52] U.S. Cl. ..... 149/2; 149/109.6; 264/3.3; 264/3.5; 264/3.6

[58] Field of Search ..... 264/3.3, 3.5, 3.6; 149/2, 109.6

[56] References Cited

U.S. PATENT DOCUMENTS

| | | | |
|---|---|---|---|
| 4,343,663 | 8/1982 | Breza et al. | 264/3.3 X |
| 4,525,225 | 6/1985 | Cechanski | 149/2 X |
| 4,714,503 | 12/1987 | Cescon et al. | 149/2 X |
| 4,746,380 | 5/1988 | Cooper et al. | 149/2 |

*Primary Examiner*—Peter A. Nelson

*Attorney, Agent, or Firm*—Cushman, Darby & Cushman

[57] ABSTRACT

In a process for the production of a 'water-in-fuel' or 'melt-in-fuel' emulsion explosive a density-reducing agent is introduced and dispersed in the emulsion at an elevated temperature whereat the emulsion is essentially liquid, the explosive is cartridged and then subsequently cooled by means of a refrigerated fluid so that the continuous phase solidifies and stabilizes the dispersion of the density-reducing agent in the explosive. Preferably, when the density-reducing agent comprises gas bubbles the explosive is subjected to an elevated pressure before it is cartridged in order to ensure that the sensitivity of the explosive will not be impaired by disturbance of gas bubbles by any pressure drop which might occur during cartridging.

The invention also extends to a cartridging machine for cartridging emulsion explosive, the machine comprising a container defining a sealed pressurizable explosives chamber which has an explosives inlet and at least one explosives outlet provided with a positive displacement pump for pumping explosive from the chamber into a cartridge.

6 Claims, 2 Drawing Sheets

PROCESS FOR THE PRODUCTION OF A CARTRIDGED EXPLOSIVE WITH ENTRAPPED BUBBLES

Figure 1:
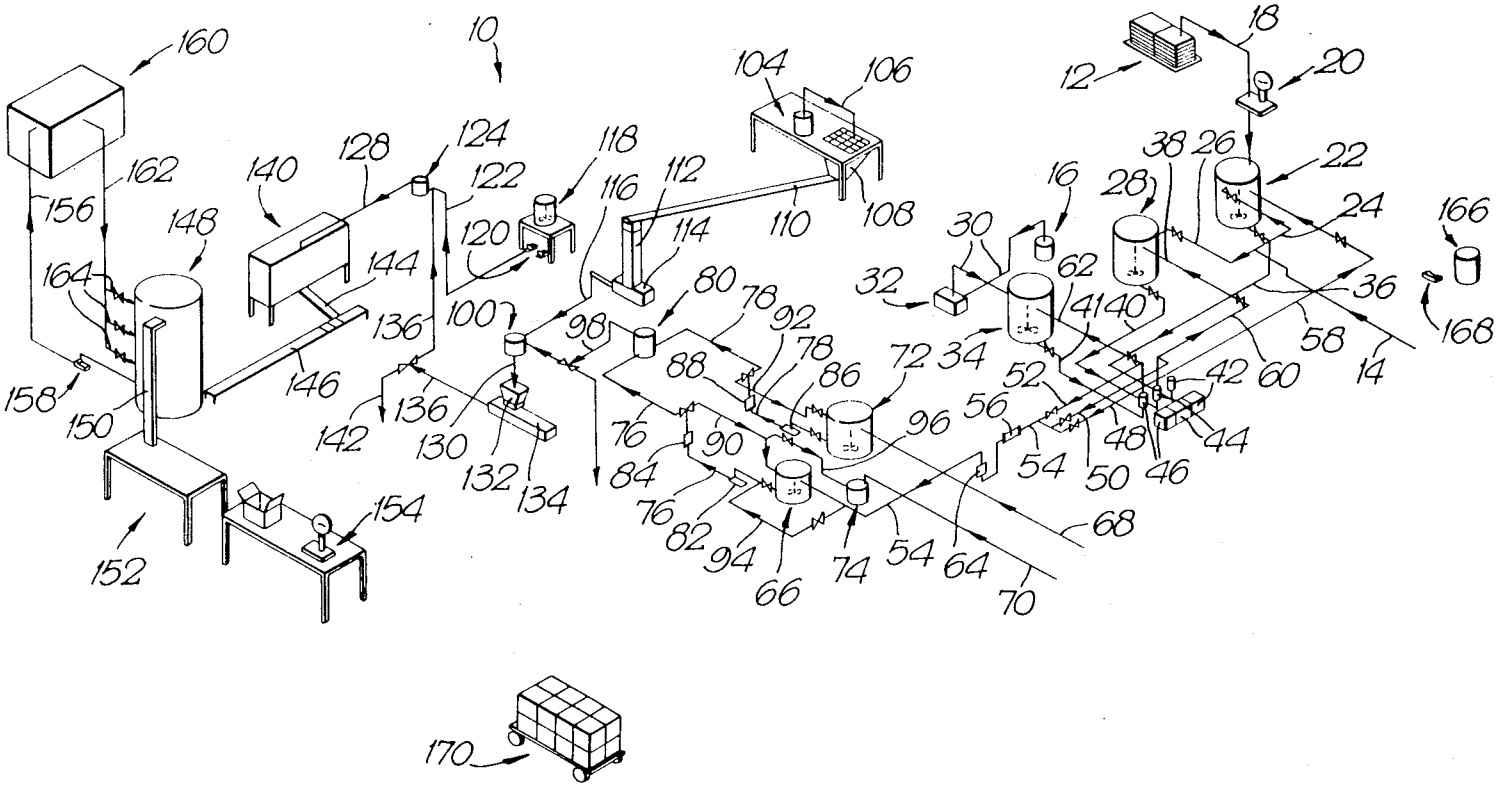

This invention relates to explosives. More particularly it relates to a process for the production of an explosive of the emulsion type in which an oxidizing salt-containing component forms the discontinuous phase in an emulsion wherein a continuous phase which is immiscible with the discontinuous phase forms a fuel component.

Such explosives often have water in their oxidizing salt-containing component and can be regarded as "water-in-fuel" emulsions, but in cases where the oxidizing salt-containing component contains no water, they can be regarded as "melt-in-fuel" emulsions.

According to the invention, in the production of a cartridged explosive in the form of an emulsion which comprises a discontinuous phase which forms an oxidizing salt-containing component and a continuous phase which is immiscible with the discontinuous phase and which forms a fuel component, by forming a base emulsion comprising said oxidizing salt-containing component and said fuel component, introducing gas bubbles into said base emulsion and dispersing them therein while the base emulsion is at an elevated temperature and is essentially liquid to form an explosive, cartridging the explosive, and then cooling the cartridged explosive by means of a refrigerated fluid so that the continuous phase solidifies, thereby to entrap the bubbles and stabilize their positions in the explosive, there is provided a process which comprises the step, after the introduction of bubbles into the base emulsion, of subjecting the explosive to an elevated pressure before it is cartridged.

Typically, the cartridging will be into paper cartridges, although the process may also be used for cartridging into plastics cartridges; and the cartridging may be by means of a pump which may be a positive displacement pump such as a piston pump or peristaltic pump which receives the explosive from a container such as a hopper. In this case the container will be pressurised, so that explosive leaving the container is at a pressure which is elevated i.e. above atmospheric pressure and typically substantially above atmospheric pressure. The elevated pressure may be in the range 50–250 kPa, preferably 100–150 kPa, the explosive being subjected for example by means of a gas such as air to this pressure.

As mentioned hereunder, in a particular embodiment of the invention the container may be in the form of a cylinder in which a piston is movable, the explosive in the container being located on one side of the piston and the pressurising air being on the other side of the piston, so that the explosive is pressurized indirectly by the air, via the piston. Movement of the piston also permits the amount of pressurized explosive in the container to vary within limits, in response to differences in flow of explosives into or out of the container. The container may also be heated by means of hot water or steam jacket/-tracing to maintain the explosive temperature at 80°–95° C.

When explosive is cartridged by means of a piston pump as described above, an outlet valve is typically employed, operatively synchronized with the piston of the pump, to replace the pump cylinder in communication with any cartridge being filled during each pumping or working stroke of the pump piston, while isolating the pump cylinder from the container, and placing the pump cylinder in communication with the container during each return stroke of the pump piston, while isolating the pump cylinder from any cartridge being filled. During such return stroke, when explosive flows from the container into the pump cylinder and in the absence of pressurization of the container as described above, a pressure drop can take place in the explosive as it is drawn into the pump, which pressure drop can be sufficiently large, and can lead to sufficiently low pressures in the explosive, for the explosive to become desensitized, and this is believed to arise from disturbances to the bubbles in the explosive. These disturbances can be to any one or more of the average bubble size, bubble size distribution, homogeneity of the bubble distribution or spacing in the explosive, escape of bubbles from the explosive, etc. The applicant has however found that if the explosive is maintained at a sufficiently high pressure at all times after the explosive has been formulated and after bubbles have at least started to form, and until the explosive has been cartridged, such desensitization can be avoided or at least reduced.

Accordingly, after the bubbles are introduced into and dispersed in the base emulsion, the explosive may be fed into a container from which container it is cartridged via a plurality of nozzles arranged in parallel into cartridges, the explosive in said container being maintained at said elevated pressure. In this case the explosive may be cartridged into cartridges by means of a plurality of positive displacement pumps arraged in parallel, the explosive passing through each said pump being maintained at said elevated pressure in the pump until it issues from the outlet of the pump. Furthermore, the bubbles may be introduced into and dispersed in the base emulsion in a blender which is operated at said elevated pressure, the explosive being maintained at said elevated pressure until it is cartridged.

The present invention will involve the selection of a continuous phase, or at least components thereof, so that the continuous phase is substantially solid at ambient temperatures, and has a softening point above ambient temperatures. At temperatures above softening point, the continuous phase should have a sufficiently low viscosity to permit formation of the emulsion itself, and to permit introduction and dispersion of gas bubbles therein, at normal elevated working temperatures.

Elevated working temperatures typically encountered in the art for emulsion formation, at which temperatures the viscosity of the continuous phase should be sufficiently low for bubble introduction and dispersion, are in the region of 85°–95° C.; and ambient temperatures of below about 35° C. are typically encountered. By suitable selection of eg waxy components in the continuous phase, such as paraffin waxes and/or microcrystalline waxes, and the proportions thereof, a continuous phase can easily be formulated with a softening point above 35° C. and a sufficiently low viscosity at 85°–95° C. Naturally, these temperatures are somewhat arbitrary, and if the explosive is intended for use at different, eg higher, ambient temperatures, and if the working temperatures for making and gassing the emulsion will be different, the continuous phase should be formulated accordingly, by routine experimentation if necessary.

Introducing bubbles into the emulsion may be by physically dispersing, eg in a suitable blender or mixer such as a static mixer, an inert gas such as nitrogen into the emulsion. Instead, a chemical gassing agent may be dispersed into the emulsion in a similar fashion, the gassing agent reacting with the emulsion or with a constituent thereof, to form the bubbles.

Typically the discontinuous phase may comprise at least one oxidizing salt selected from the group consisting in:

ammonium nitrate
alkali metal nitrates
alkaline earth metal nitrates
ammonium perchlorate
alkali metal perchlorates; and
alkaline earth metal perchlorates.

The oxidizing salt will be present in the form of an aqueous solution or melt in the discontinuous phase.

In the case of melt-in-fuel emulsions or emulsions in which the discontinuous phase contains very little if any water, the discontinuous phase may solidify at ambient temperatures, but the explosive is still regarded as an emulsion for the purpose of the present invention.

The discontinuous phase may comprise ammonium nitrate with at least one further compound selected from the group consisting in oxygen-releasing salts and fuels which, together with the ammonium nitrate, forms a melt which has a melting point which is lower than that of ammonium nitrate. Such further compound may be an inorganic salt such as lithium nitrate, silver nitrate, lead nitrate, sodium nitrate, calcium nitrate, potassium nitrate, or mixtures thereof. Instead or in addition, the compound which together with the ammonium nitrate on heating forms a melt having a melting point which is lower than the melting point of ammonium nitrate may be an alcohol such as methyl alcohol, ethylene glycol, glycerol, mannitol, sorbitol, pentaerythritol, or mixtures thereof. Other compounds which can instead or in addition be used to form the melt together with ammonium nitrate may be carbohydrates such as sugars, starches and dextrins, and aliphatic carboxylic acids and their salts such as formic acid, acetic acid, ammonium formate, sodium formate, sodium acetate, and ammonium acetate. Yet further compounds which can instead or in addition be used to form melts with ammonium nitrate include glycine, chloroacetic acid, glycolic acid, succinic acid, tartaric acid, adipic acid, and lower aliphatic amides such as formamide, acetamide and urea. Urea nitrate can also be used as can certain nitrogeneous substances such as nitroguanidine, guanidine nitrate, methylamine, methylamine nitrate, and ethylene diamine dinitrate. Each of these substances may be used alone with the ammonium nitrate, or mixtures thereof can be used to form the melt of the ammonium nitrate, the mixtures being selected to form melts with the ammonium nitrate having suitably low melting points and being substantially insoluble in the continuous phase.

In general, the substance(s) chosen to form melts with the ammonium nitrate are selected by the criterion, in addition to costs, that they form melts with acceptably safe and low melting points, for example, within the range 70° C. to 130° C., although melts with melting points above 130° C. can in principle be used.

The fuel will be immiscible with and insoluble in water, and is preferably an organic fuel which may be non-self-explosive and may comprise at least one member of the group comprising hydrocarbons, halogenated hydrocarbons and nitrated hydrocarbons. As mentioned above, the fuel typically contains one or more waxes, such as paraffin waxes, microcrystalline waxes and/or slack waxes, whereby its softening point and viscosity are controlled, and it may also include one or more members of the group comprising mineral oils, fuel oils, lubricating oils, liquid paraffin, xylene, toluene, petrolatum and dinitrotoluene.

In general, water in the discontinuous phase will be kept to a minimum consistent with formulating the discontinuous phase and with formulating the emulsion at an elevated temperature which is acceptably low, so as to avoid unnecessarily wasted energy arising from steam production upon eventual detonation.

The fuel component of the emulsion may comprise at least one emulsifier selected from the group consisting of sorbitan sesquioleate, sorbitan monooleate, sorbitan monopalmitate, sodium monostearate, sodium tristearate, the mono- and diglycerides of fat-forming fatty acids, soya bean lecithin, derivatives of lanolin, alkyl benzene sulphonates, oleyl acid phosphate, laurylamine acetate, decaglycerol decaoleate, decaglycerol dicastearate, 2-oleyl-4,4'-bis(hydroxymethyl)-2-ozazoline, polymeric emulsifiers containing polyethylene glycol backbones with fatty acid side chains and polyisobutylene succinic anhydride derivatives.

The emulsifiers act as surfactants and stabilizers to promote the formation of the emulsion and to resist crystallization and/or coalescence of the discontinuous phase.

Typical proportions by mass of oxidizing salts, fuels and emulsifiers employed in the explosive are:

oxidizing salts - 75–95%, preferably 91–93%
fuels - 3.2–6.5%, preferably 3.4–5.1%
emulsifiers - 0.95–2.0%, preferably 1.0–1.4%.

The density of the emulsion will be such as to form a suitable explosives composition after incorporation of the bubbles. The base emulsion may thus have a density of eg about 1.30–1.56 g/cm$^3$ at 25° C. The density of the eventual explosive should, after bubble introduction, be less than 1.26 g/cm$^3$, preferably in the range 1.15–1.20 g/cm$^3$ at 25° C.

In a particular embodiment of the invention, the oxidizing salt-containing component preferably comprises, at least in part, ammonium nitrate, in which case a chemical gassing agent comprising nitrite ions, eg sodium nitrite, may be employed, conveniently in the form of an aqueous solution of say 15–30% m/min concentration, eg 20% m/m, which is blended into the emulsion at said elevated temperature.

As soon as blending is initiated, nitrite ions start to react with ammonium ions in accordance with the equation $$NO_2^- + NH_4^+ \rightarrow N_2 + 2H_2O$$

to produce nitrogen bubbles.

It is desirable to form evenly distributed gas bubbles in the eventual cartridged emulsion of an average size (diameter) in the range 20–30, eg 25 microns, and to have bubbles of a relatively uniform size, ie a relatively narrow bubble size distribution. The desired bubble size and bubble size distribution can be promoted by selecting an appropriate reaction speed and appropriate blender characteristics.

Reaction speed is controlled by the temperature and the pH for the above nitrite/ammonium reaction, and for temperatures of 85°–95° C., a pH of 3.8–4.7 has been found to be suitable, eg a pH of about 4.0 at 90° C. The blender in turn should mix the sodium nitrite solution into the base emulsion to substantial homogeneity sufficiently quickly, preferably in less than 60 seconds and more preferably in less than 40 seconds. This is effected by sufficiently increasing the rotation rate of a blender, or by selecting a static mixer blender so that the turbulence created therein, arising from the flow rate therethrough, is sufficiently high.

The amount of sodium nitrite used will depend on the proportion or number of bubbles required, ie on the eventual density required for the explosive, and, if desired, one or more catalysts such as thiourea, thiocyanate or urea may be dissolved into the discontinuous phase prior to said blending, to accelerate the nitrite/ammonium reaction.

Preferably the emulsion with bubbles should be cooled sufficiently quickly after cartridging before unacceptable bubble loss, migration or coalescence has taken place, and while the bubbles are homogeneously distributed through the emulsion. Furthermore, when a wax-based formulation is used for the continuous phase, it conveniently has a hardness according to the Stanhope Penetrometer method of 10–16 mm, preferably 13.5 mm at the maximum anticipated ambient temperature of eg 35° C. and a setting point at 5°–15° C., eg 10° C., above said anticipated temperature. For this type of wax based continuous phase, cooling should be started as soon as possible after cartridging, eg 1–5 seconds thereafter or less, and the explosive in the cartridges should be cooled to the anticipated ambient temperature in no more than about 12 minutes, preferably in 5–12 minutes and typically less than 7 minutes depending on cartridge diameter. In this regard it should be borne in mind that the explosive can be pumped from the blender to the cartridging machine with sufficient turbulence to prevent any unacceptable bubble loss of coalescence, but if there is nevertheless a danger of such loss or coalescence, the blending/cartriding interval should be kept sufficiently small eg less than 5 seconds, say 1 second.

Cooling may be by means of a cooling fluid, eg. air or water, sprayed or otherwise applied to/circulated around the cartridges. This cooling fluid is preferably at a temperature of no more than about 10° C. but can be higher, depending on the wax blend used, and no less than about 3° C. Water can be used for plastics cartridges and air for paper cartridges. The upper temperature limit of the cooling fluid is set by the need to form small wax crystals in the bilayer of the continuous phase as it solidifies, to permit these wax crystals to form between gas bubbles on the one hand and preferably between droplets of discontinuous phase on the other, thereby to resist bubble coalesence and droplet coalescence and, if there is any crystallization of discontinuous phase in the droplets, to resist propagation of such crystallization from one droplet to another. The small continuous phase wax crystals thus act to keep the droplets apart from one another and the bubbles apart from one another, by forming a more or less solid matrix around them, and in this regard they are more effective than the larger crystals typically obtained in the continuous phase upon slow (eg natural) cooling, which cannot penetrate as easily between adjacent droplets or adjacent bubbles.

On the other hand a cooling fluid temperature of less than 3° C. is undesirable because cooling which is too rapid can cause undesirable crystallization in the droplets of discontinuous phase, which leads to a drop in sensitivity and stability. A cooling fluid temperature of about 5° C., leading to cooling from 90° C. down to the anticipated ambient temperature of 35° C. in about 7 minutes, has been found to be adequate. A cooling device having a cartridge conveyor passing therethrough may be used for forced cooling, cooling fluid being passed through the device and the speed of the conveyor being adjusted so that the cartridges emerge from the cooling device as soon as they reach the anticipated ambient temperature. In this regard it is to be noted that forced cooling has the advantage that it can prevent expansion of the plastics cartriding material to avoid unsightly wrinkling on cooling of the cartridges, for good product appearance; and in the case of waxed paper cartriding material where the filled cartridges can slump into an oval shape upon natural cooling, this slumping is resisted by cooling of the wax in the paper, which can be a substantial advantage for loading into round holes.

It is a further particular advantage of the process that, althouth it can be run batchwise, it lends itself to continuous operation, the base emulsion being formed continuously at an elevated temperature and being fed continuously to the blender for bubble formation, after which it is fed to a continuous cartridging process and the cartridges are fed to a continuous cooling stage. Thus, preferably, the process is a continuous process.

The invention extends also to a cartridged explosive, such as a 22 mm to 32 mm cartridged emulsion explosive, whenever produced by the process described above, specifically to 22 mm, 25 mm, 29 mm and 32 mm cartridges.

The invention extends also to a cartridging machine for cartridging an emulsion explosive in a cartridge, which cartridging machine comprises a container defining a sealed pressurizable explosives chamber, the chamber having an explosives inlet and at least one explosives outlet provided with a positive displacement pump for pumping explosive from the compartment into a cartridge.

The chamber may have a movable wall, so that a force applied to said wall in a direction to reduce the volume of the chamber can pressurize the chamber.

Instead and in addition, the container may have an opening into its interior for a pressurizing fluid, whereby the chamber and an explosive in it may be pressurized.

In a particular embodiment, the container may be in the form of a cylinder having a piston reciprocable in its interior and dividing its interior into a pair of chambers, namely said explosives chamber and a pressure chamber, the piston forming the movable wall of the explosives chamber and the opening into the container for a pressurizing fluid leading into the pressure chamber. This embodiment thus has both the features of a movable wall and said opening for a pressurizing fluid.

The piston may have a piston rod projecting out of the container via an opening in the container, said opening being provided with sealing means for preventing fluid flow therethrough. The part of the rod projecting out of the container may be associated with or connected to control means for controlling the flow of an explosives supply, via the explosives inlet, into the container.

The explosives chamber may have a plurality of outlets, each provided with a positive displacement pump.

Each pump may be reciprocable, and may be a reciprocable piston and cylinder dosing pump, the machine including a valve for each pump and operatively synchronized therewith, and a delivery nozzle for each pump for feeding explosive pumped by the pump into a cartridge, the valve being synchronized with the pump to place its cylinder in communication into the nozzle during each working stroke of the pump while isolating said cylinder from the explosive chamber, and to place said cylinder in communication with said chamber during each return stroke of the pump while isolating said cylinder from said nozzle. Each valve may be a rotary valve and may be synchronized with the associated pump by being operatively coupled therewith or connected thereto.

Figure 2:
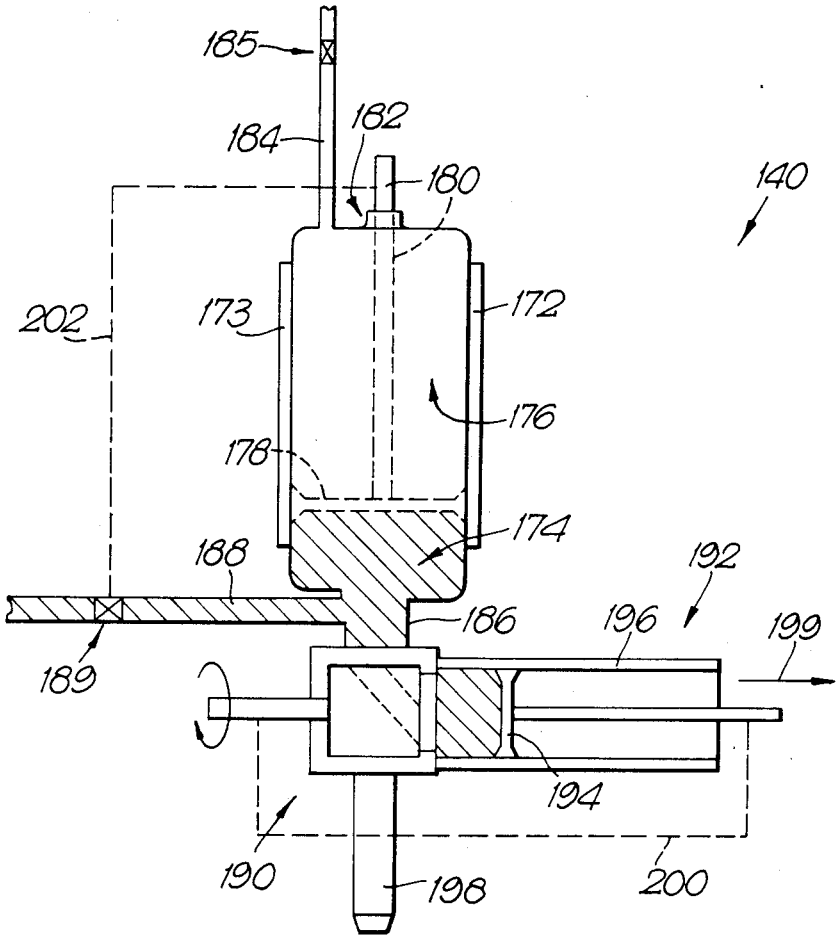

The invention will now be described, by way of example, with reference to the following non-limiting illustrative examples, and with reference to the accompanying schematic drawing, in which:

FIG. 1 shows a diagrammatic flow diagram of a process in accordance with the present invention; and FIG. 2 shows a diagrammatic sectional side elevation of part of a catridging machine according to the invention.

In the drawing reference numeral 10 designates a flow diagram of an installation for carrying out the process of the present invention. The installation 10 comprises a wax store 12, an oil supply line 14 from a tank farm (not shown) and a surfactant store 16. The wax store 12 is connected by a flow line 18 including a weighing station 20 to a wax holding tank 22. The oil supply line 14 is in turn connected by flow lines 24 and 26, provided with shut-off valves, respectively to the wax holding tank 22 and an oil holding tank 28. The surfactant store 16, which is a tank, is connected by a flow line 30 including a pump 32, to a surfactant holding tank 34. The holding tanks 22, 28 and 34 are mixing vessels having mechanical paddles therein as shown.

The holding tanks 22, 28 and 34 feed respectively along flow lines 36, 40 and 41 to metering pumps 42, 44 and 46, each of said flow lines 36, 38 and 40 being provided with shut-off valves. The metering pumps 42, 44 and 46 respectively feed via flow lines 48, 50 and 52, provided with shut-off valves, into a common flow line 54, which feeds through a static mixer 56. The flow lines 48, 50 and 52 are respectively provided with branch flow lines 58, 60 and 62, each provided with a shut-off valve respectively for recirculating liquid back into the wax holding tank 22, into the oil holding tank 28 and into the surfactant holding tank 34.

The static mixer 56 feeds along the common flow line 54 via a flow rotameter 64 into a liquid fuel holding tank 66. Oxidizing solution and oil supply lines 68 and 70, both leading from the tank farm, lead respectively to an oxidizing solution holding tank 72 and an oil flushing tank 74. The tanks 66 and 72 feed respectively via flow lines 76 and 78 to an emulsifier device 80. The flow line 76 is provided with a pump 82 and a flow rotameter 84 and the flow line 78 is similarly provided with a pump 86 and a flow rotameter 88. The flow lines 76 and 78 are respectively provided with branch flow lines 90 and 92, for recirculating liquid fuel and oxidizing solution respectively to the tanks 66 and 72. The tanks 66 and 72 are mixing tanks provided with paddles, and the flow line 92 is provided with a shut-off valve.

The oil flushing tank 74 feeds via a flow line 94 provided with a shut-off valve into the flow line 76, and a flow line 96 provided with a shut-off valve, leads from the flow line 90 into the oil flushing tank 74. In this regard it should be noted that, in the flow lines 76 and 78, the respective pumps 82 and 86 are upstream of the respective rotameters 84 and 88, and each of said flow lines 76, 78 has a shut-off valve, the shut-off valves being respectively upstream of the associated pumps 82, 86, the flow line 90 branching at a three-way shut-off valve from the flow line 76 between the rotameter 84 and the emulsifier device 80, and the flow line 92 branching at a three-way shut-off valve from the flow line 78 between the rotameter 88 and emulsifier device 80. The flow line 94 enters the flow line 76 between the pump 82 and the shut-off valve in the line 76.

The emulsifier device 80 leads via a flow line 98 to a dry dopes blender 100, the flow line 98 being provided with a branch flow line 102 branching from a three-way valve to a waste store (not shown).

An atomized aluminium store 104 leads in series via a flow line 106, hopper 108 and flexible auger 110 to a hopper 112 which in turn leads in series via an auger 114 and flow line 116 to the blender 100.

A sodium nitrite store 118, which is a mixed tank provided with a paddle, leads via a pump 120 feeding into a flow line 122, to a gassing blender 124, which has a discharge flow line 128.

The blender 100 feeds via flow line 130 and hopper 132 to a blended product pump 134 which discharges via a flow line 136 to the blender 124, the flow line 122 entering the flow line 136 immediately upstream of the blender 124. The flow line 128 leads to a cartridging machine 140. The flow line 136 is provided with a branch flow line 142 branching from a three-way valve to a waste store (not shown).

The cartridging machine 140 is described in more detail hereunder with reference to FIG. 2.

The cartridging machine 140 feeds via a cartridge chute or slide 144 on to a cartridge conveyor 146 which leads to a cooling device 148. The cooling device 148 discharges via a chute 150 to a packaging facility or station generally designated 152 and provided with weighing means 154.

The cooling device 148 is a so-called spiral chiller of the type used in the food industry, typically used for chilling processed foods, such as hamburger patties. The Applicant has found that this device is entirely suitable for chilling cartridges of explosives. The device in question is obtainable from Grenco South Africa (Proprietary) Limited, Kempton Park. The cooling device 148 is of stainless steel construction and has a variable speed spirally arranged conveyor in its interior, for conveying articles to be chilled from its lower end, into which the conveyor 146 feeds, to its upper end, where the variable speed conveyor feeds into the chute 150. The device 148 is a closed system forming part of an air recirculation system. Air is pumped through a duct into the top of device 148 at speeds of 12 m/s and ducted from the bottom and passed through a heat exchanger.

In the drawing, the cooling device 148 is shown connected to a flow line 156 provided with a blower 158, leading to a refrigeration plant 160. A flow line 162 returns from the refrigeration plant 160 to the device 148.

With regard to the installation 10 shown in the drawing, it should be noted that the tanks 22 and 28 are provided with steam coils, and the various flow lines for carrying the contents of these tanks in a downstream direction to the cartridging machine 140 are provided with water jackets. These water jackets have water or hot condensate from low pressure steam circulating therethrough at about 95° C. The jacketed flow lines include the flow lines 36 and 38, the flow lines 48, 50 and 54, the recirculation flow lines 58 and 60, flow line 76, and recirculation flow line 90 and flow lines 98, 102, 136 and 142. Flow lines 68 is steam traced. Various other items such as the tank 66 will have a low pressure steam coil at the same temperature, as can, if desired, items such as emulsifiers, blenders, pumps, mixers, rotameters, etc, where practicable, or at least such items can be lagged to prevent heat loss. In this regard a calorifier is shown at a 166 with an associated pump 168 for providing hot water at 95° C. for the water jacketing. Tank 72, with flow lines 78 and 92 are steam jacketed to obviate solution fudging problems.

Similarly, the tank 34 and the associated flow lines 52 and 62, are supplied with a means of electrical heating to maintain a temperature of about 35°–40° C. as explained hereunder.

It should also be noted that a trolley carrying boxes of cartridged explosives is shown at 170, downstream of the packing station 152.

Turning to FIG. 2, a cartridging machine suitable for the flow diagram and process of FIG. 1 is generally designated 140. The machine 140 comprises a container 172 (housed in the housing visible at 140 in FIG. 1) in the form of a metal accumulator or pressure vessel provided with a means 173 of heating. The vessel 172 acts as a cylinder and is divided into an explosive chamber 174 and a pressure chamber 176 by a piston 178, forming a piston and cylinder arrangement together with said piston 178, which is slidable longitudinally along the interior of the vessel 172, and which will typically be mounted in an upright condition as shown. The piston 178 has a piston rod 180 which projects upwardly out of the top of the container 172 via a substantially airtight sealing arrangement at 182. The chamber 176 communicates at the top of the container 172 via a gas line 184 with a source of air under pressure (not shown) at about 125 kPa pressure. The flow line 184 has a shut-off valve 185.

At the bottom of the container 172 the chamber 174 has a neck 186 providing an explosives outlet and, into the neck 186, an inlet passage 188 for explosives which communicates with, and forms an extension of, the flow line 128 (FIG. 1), a flow control valve 189 being shown in the flow line 188.

The outlet 186 communicates via a rotary valve 190 with a piston pump 192 having a piston 194 and cylinder 196. The rotary valve 90 is synchronized with the piston 194 and operatively connected thereto by means (not shown) whereby the cylinder 196 is placed in communication with the outlet 186 during each return or suction stroke of the piston 194, and in communication with a dosing nozzle 198 with each working or pumping stroke of the piston 194. In this regard, although one nozzle 198 is shown in FIG. 2, there may be several (eg up to twelve) connected in parallel to one another and each fed by a pump 192 operating in synchronization. A return stroke of the piston 194 is in the direction of arrow 199 and a working stroke of the piston 194 is in the direction opposite to arrow 199. For ease of illustration only valve 190, pump 192 and nozzle 198 are shown, but where there are several, the outlet neck may simply lead into a manifold having a plurality of outlets to which the valves 190 are connected and via which they are fed.

The pump 192 is shown operatively synchronized with the valve 190 by a linkage represented diagrammatically by dotted line 200; and the rod 180 is shown diagrammatically associated with control means represented by dotted line 202, leading to valve 189.

In accordance with the process of the present invention waxes are transported from the wax store 12 along flow line 18 to the tank 22, being weighed at the weighing station 20. In the tank 22 the wax is melted at 90° C., and circulated by the paddle at 90° C. Oil from the flow line 14 passes along flow line 26 to the tank 28, where it is mixed and heated to 90° C.

The wax blend from the tank 22 is pumped via metering pump 42 along flow lines 36 and 48 to the flow line 54, as is oil from the tank 28 by means of the metering pump 44 along flow lines 40 and 50. Simultaneously, surfactant is pumped from the surfactant store 16 along flow line 30 by pump 32 to the tank 34, where it is electrically heated to 35°–40° C. Surfactant is then pumped by metering pump 46 along flow lines 41 and 52 to the flow line 54. In this regard it should be noted that, if for any reason flow along flow line 54 is stopped, the metering pumps 42, 44 and 46 can continue to operate, recirculating respectively wax blend along flow line 58 to the tank 22, oil along flow line 60 to the tank 28 and surfactant along the flow line 62 to the tank 34.

In the flow line 54 mixing of emulsifier, wax blend and oil takes place in the static mixer 56, and this flow is metered by the rotameter 64. The mixed fuel blend passes along flow line 54 to the tank 66.

Oxidizing solution from the tank farm simultaneously passes along flow line 68 to the tank 72, and fuel and oxidizing solution are simultaneously pumped respectively from the tanks 66 and 72 via the associated pumps 82 and 86 and flow lines 76 and 78 to the emulsifier device 80. In this regard it should be noted that, should flow through the emulsifier device 80 be stopped for any reason, the pump 82 can recirculate fuel to the tank 66 via flow line 90, and the pump 86 can recirculate oxidizing solution via flow line 92 to the tank 72. The flow line 70 is for supplying flushing oil from the tank farm, which oil is stored in tank 74, and can be used via flow lines 94, 90 and 96, to flush the flow line 76 upstream of its connection to the flow line 90, the pump 82, the flow line 90 and with the tank 66.

In the emulsifier device 100 the fuel and oxidizing salt solution are emulsified and emulsified fuel/oxidizer base emulsion passes from the emulsifier device 80 along flow line 98 to the blender 100, the flow line 102 carrying this flow to waste when desired, eg should flow through the blender 100 be stopped for any reason.

When sorbitan oleate is used as the emulsifier, it should be noted that the flow thereof along line 52 at 35°–40° C. enters the flow line 54 close to the static mixer 56, so that the emulsifier is dispersed throughout the fuel very shortly after its temperature is increased to 90° C. in the flow line 54. Furthermore, the capacity of the liquid fuel tank 66 and the lengths of the flow lines 54 and 76 are selected, so that fuel containing emulsifier entering the flow line 54 passes through the emulsifier device 80 no later than 15 minutes after entering the flow line 54. This is because sorbitan oleate can be degraded at 90° C., so that the emulsion must be formed quickly.

Simultaneously, atomized aluminium is fed from the store 104 along flow line 106 and through the hopper 108 to the auger 110. The auger 110 passes said atomized aluminium through the hopper 112 and auger 114 via flow line 116 into the blender 100.

In the blender 100 the base emulsion from the emulsifier device 80 is blended with atomized aluminium from the flow line 116. From the blender 100 the base emulsion/aluminium mixture passes via flow line 130 and hopper 132 through pump 134 and flow line 136 via density gauge 138 to the blender 124. Simultaneously, sodium nitrite is fed by the pump 120 from the store 118 along flow line 122 to the blender 124. In the blender 124 sodium nitrite is blended into the base emulsion-/aluminium mixture, and the blended explosive then passes from the blender 124 along flow line 128 to the cartridging machine 140 where the explosive is cartridged into cartridges continuously and automatically. The blender 124 optionally has a water jacket or lagging, to maintain its temperature as close as practicable to 90° C. Should the cartridging machine 110 cease operation blended base emulsion can pass along flow line 142 to waste.

In the cartridging machine (FIG. 2) the pressure chamber 176 is kept continually at a pressure of eg 125 kPa by compressed air from the line 184. Explosive to be cartridged enters the chamber 174 more or less continuously under pressure from the inlet passage 188 (flow line 128 - FIG. 1) and is pumped from the chamber 174 by the pump 192 via the nozzle(s) 198 into the cartridge(s) (not shown). In this regard, the operation of the valve 190, pump 192 and nozzle(s) 198 is substantially conventional. However, it should be noted that the position of the rod 180, via the control means 200 and valve 189, ensures that the amount of explosive in the chamber 174 remains between desired limits. It is also important to note that the pressurization of the chamber 176 to 125 kPa via the flow line 184 provides substantial novel and unexpected benefits.

Thus, keeping this pressure at 125 kPa, ie at an elevated pressure substantially above atmospheric pressure, ensures that the explosive in the chamber 174 is always kept, via piston 178, at substantially the same elevated pressure of about 175 kPa. It follows that explosive must be fed into chamber 174 via passage 188 at a pressure sufficient to cause flow into the chamber 174, and this can be done eg via a suitable pump (not shown) in the flow line 188.

As the explosive in the chamber 174 is at a substantial pressure, movement of the pump piston 194 along a return stroke in the cylinder 196 does not lead to any pressure drop in the explosive leaving the chamber 174 and entering the cylinder 196 during said return stroke, to below atmospheric pressure, as can be the case when the explosive in the chamber 174 is unpressurized. Naturally, during the succeeding working stroke of the piston 194 whereby the explosive is pumped via the valve 190 and a nozzle 198 into the associated cartridge, the pressure in the explosive passing into the cartridge(s) will remain at a pressure not less than atmospheric pressure. Indeed, bearing in mind that the chamber 176 is filled with a compressible gas (air) at 125 kPa and bearing in mind that the volume of the cylinder 196 is relatively small compared with that of the chamber 176, the pressure in the explosive will be substantially above atmospheric pressure at all times, until the valve 190 cuts the cylinder 196 off from the chamber 174, at which stage pressure in the explosive drops to at or slightly above atmospheric pressure. In this regard it should be noted that, in FIG. 2 the pump 192 is shown on an enlarged scale relative to the container 122, for ease of illustration.

The Applicant has found that pressurizing the container 172 as described above prevents or at least reduces desensitization of the explosive, believed to arise from undesirable coalescence and/or migration of gas bubbles which are present or are forming in the explosive in the container 172, which coalescence and/or migration can take place in response to reduction of pressure in the explosive to below atmospheric pressure, when the pump 192 sucks explosive out of the bottom of the container 172 and the container 172 is unpressurized, ie is under atmospheric air pressure.

With reference to FIG. 2, it should also be noted that the piston rod 180 is conveniently associated with means (not shown) which acts as an explosive level control in the container 172. Thus the rod 180, when the container 172 is nearly full of explosive, may act to close off explosive supply to chamber 174 via line 188, and may be arranged to cause said supply to resume when the explosive level in the container 172 drops. The explosive in chamber 174 is kept at a minium to reduce wastage in case of a breakdown or shutdown of the system.

When the cartridges are filled, they pass in the usual way to the chute 144. Thus, from the cartridging machine 140, cartridges filled with explosive pass along chute 144 to conveyor 146, and along conveyor 146 into the cooling device 148. The cartridges pass upwardly through the cooling device 148, in which they have chilled air directed at them when the cartridging material is paper. Chilled cartridges emerge from the top of the cooling device 148 and pass via chute 150 to the packing station 125 where they are packed into cartons, which are then weighed on the weighing means 154 and removed on trolleys, eg as shown at 170.

The spent cooling water or air, as the case may be, is recirculated from the cooling device 148 by means of the pump blower 158 through the flow line 156 to the refrigeration plant 160, where it is continuously chilled, and then returned along flow line 162 to the flow lines 164.

In this regard, as filling by means of a piston pump 192 as shown is usually used for paper cartridges, the process will typically involve paper catridges and air cooling in the device 148.

The base emulsion entering the blender 124 will contain ammonium nitrate, and ammonium ions in the blended explosive will react with nitrite ions from the sodium nitrite according to the reaction:

$$NO_2^- + NH_4^+ \rightarrow N_2 + 2H_2O$$

to produce bubbles of nitrogen as a density reducing agent in the explosive. These bubbles form in the explosive in the flow line 128 and chamber 174. Gassing thus goes to completion before the product enters the cartridges. The pH of the oxidizing solution from the flow line 68 is adjusted appropriately to 4.0 and the oxidizing solution containing thiourea accelerator for the above reaction. It was found that by the application of a positive pressure to the explosive in the container 172 migration and coalescence of gas bubbles was prevented sufficiently so as to allow gassing to go to completion before dosing into the cartridges while still retaining desirable explosive characteristics.

As regards the operation of the cooling device 148, water will be sprayed into the chiller 148 at about 7° C. or air at about 5°-7° C., the variable speed conveyor in the device 148 being set at a speed such that the cartridges emerge along chute 150 at a temperature no greater than 35° C. In this regard it should be noted that the capacity of the cooling device 148 will be selected such that its throughput is greater than that of the cartridging machine 140 and such that the residence time of cartridges in the device 148 is about 7 minutes. It should further be noted that the chute 144 and conveyor 146 are selected and constructed so that cartridges are conveyed quickly from cartridging machine 140 to the cooling device 148, preferably in about 1–5 seconds, so that cooling in the device 148 is initiated before any unacceptable migration/segregation of bubbles takes place in the hot explosive in the cartridges; and so that the continuous fuel phase of the explosive solidifies and crystallizes with a fine grain or crystal structure.

The short interval between cartridging and cooling will also serve to prevent any unacceptable coalescence or loss of bubbles introduced into the cartridged explosive, and rapid solidification of the emulsion, whose wax constituents are selected to ensure solidification thereof at temperatures not less than 35° C., entraps and fixes in place the bubbles in the explosive product, as well as the droplets of discontinuous phase formed by the oxidizing solution.

In tests conducted with the installation 10 shown in the drawing, it was found that the rapid cooling of the explosive caused the continuous phase of the emulsion, formed by the fuel component to form relatively small crystals. These crystals penetrated between droplets of the discontinuous oxidizing salt phase to separate them and resist their coalescence, and the wax crystals also penetrated between gas bubbles to maintain an even distribution thereof throughout the explosive in the cartridges and to prevent or at least resist coalescence and loss of gas bubbles. This forced cooling, which starts before any material natural cooling of the cartridges can take place, is to be contrasted with natural cooling where the continuous phase crystallizes slowly with formation of large crystals and the associated disadvantages. Furthermore, it was noted that if cooling took place too rapidly or took place with cooling fluid which was too cold, undesirable crystallization of the discontinuous phase could take place, with the associated disadvantage of a drop in stability.

The invention will now be described in more detail with reference to the following non-limiting illustrative Examples. In the Examples an explosive formulation of the following composition was used.

| Constituent | % m/m |
|---|---|
| Ammonium nitrate (88% m/m aqueous) | 79,54 |
| Sodium nitrate | 13,07 |
| Thiourea | 0,10 |
| Water | 0,78 |
| Mineral oil | 0,99 |
| Sorbitan mono-oleate | 1,39 |
| Paraffin wax· | 2,63 |
| Microwax | 1,41 |
| Sodium nitrite | 0,09 |

The mineral oil was P95mineral oil obtained from BP South Africa (Pty) Ltd; the sorbitan mono-oleate was Crill 4 emulsifier obtained from Croda Chemicals South Africa (Pty) Ltd; the paraffin wax was Aristo wax obtained from Sasol Chemicals (Pty) Ltd; and the microcrystalline wax was Be Square Amber wax obtained from Bareco Inc., U.S.A.

This formulation when gassed under controlled conditions to a density of 1.15 g/ml could be detonated with a detonator comprising 22 mg of pentaerythritol tetranitrate (PETN) and had a velocity of detonation of 4.5 km/s.

EXAMPLE 1

The above formulation was prepared but with a sodium nitrite content sufficient to give a density of 0.9 g/ml and was cartridged by a cartridging machine of the type shown in FIG. 2 but without any pressurization via line 84, ie with line 184 open to atmosphere.

After cartridging and cooling the product density was found to have increased to 1.35–1.40 g/ml and the product was found to be insensitive to detonation by 780 mg of PETN.

EXAMPLE 2

The same formulation as Example 1 was prepared with sufficient sodium nitrite to give a density of 1.17 g/ml and was also cartridged by the same cartridging machine as Example 1 except that the container 172 was pressurized in the range 50 kPa to 250 kPa yielding the following results:

Densities were obtained in the range 1.17–1.20 g/ml. The product was sensitive to detonation by detonators containing 44–88 mg of PETN with velocities of detonation of 3.5–4.0 km/s.

Similar results were also obtained by direct air pressurization of the explosive, ie without the use of the piston 178.

We claim:

1. In the production of a cartridged explosive in the form of an emulsion which comprises a discontinuous phase which forms an oxidizing salt-containing component and a continuous phase which is immiscible with the discontinuous phase and which form a fuel component, by forming a base emulsion comprising said oxidizing salt-containing component and said fuel component, introducing gas bubbles into said base emulsion and dispersing them therein while the base emulsion is at an elevated temperature and is essentially liquid to form an explosive, cartridging the explosive, and the cooling the cartridged explosive by means of a refrigerated fluid so that the continuous phase solidifies, thereby to entrap the bubbles and stabilize their positions in the explosive, a process which comprises the step, after the introduction of bubbles into the base emulsion, of subjecting the explosive to an elevated pressure before it is cartridged.

2. A process as claimed in claim 1, in which the elevated pressure is in the range 50–250 kPa.

3. A process as claimed in claim 1, in which, after the bubbles are introduced into and dispersed in the base emulsion, the explosive is fed into a container from which container it is cartridged via a plurality of nozzles arranged in parallel into cartridges, the explosive in said container being maintained at said elevated pressure.

4. A process as claimed in claim 1, in which the explosive is cartridged into cartridges by means of a plurality of positive displacement pumps arranged in parallel, the explosive passing through each said pump being maintained at said elevated pressure in the pump until it issues from the outlet of the pump.

5. A process as claimed in claim 1, in which the bubbles are introduced into and dispersed in the base emulsion in a blender which is operated at said elevated pressure, the explosive being maintained at said elevated pressure until it is cartridged.

6. A cartridged explosive whenever produced according to the process of any one of the preceding claims.

* * * * *